US006402427B1

(12) United States Patent
James

(10) Patent No.: US 6,402,427 B1
(45) Date of Patent: Jun. 11, 2002

(54) METHOD FOR REINFORCING TUNNEL LININGS

(76) Inventor: Peter James, 2 Redd Landes, Shirenewton, Chepstow, Gwent (GB), NP6 6QP ( * ) Notice: Subject to any disclaimer, the term of this patent is extended or adjusted under 35 U.S.C. 154(b) by 0 days.

(21) Appl. No.: 09/731,699

(22) Filed: Dec. 8, 2000

(30) Foreign Application Priority Data

Dec. 10, 1999 (GB) ..... 9929123

(51) Int. Cl.[7] ..... E21D 11/00

(52) U.S. Cl. ..... 405/150.1; 405/150.2; 405/132

(58) Field of Search ..... 405/150.1, 150.2, 405/151–153, 132, 146–147, 135, 267, 268

(56) References Cited

U.S. PATENT DOCUMENTS

| | | | | | |
|---|---|---|---|---|---|
| 2,208,302 | A | * | 7/1940 | Fernandez | 405/153 |
| 2,568,010 | A | * | 9/1951 | Kieser | 405/150.1 |
| 2,602,299 | A | * | 7/1952 | Sonderegger | 405/150.1 |
| 3,673,806 | A | * | 7/1972 | Hanig et al. | 405/153 |
| 4,052,860 | A | * | 10/1977 | Alterman | 405/259.5 |
| 4,432,667 | A | * | 2/1984 | Richardson | 405/150.1 X |
| 4,465,405 | A | * | 8/1984 | Durrfeld | 405/132 X |
| 4,545,701 | A | * | 10/1985 | Tsuzuki | 405/153 |
| 4,662,773 | A | * | 5/1987 | Baumann et al. | 405/152 |
| 4,695,188 | A | * | 9/1987 | Pulkkinen | 405/150.2 |
| 4,895,480 | A | * | 1/1990 | Jackel et al. | 405/150.1 X |
| 4,940,360 | A | * | 7/1990 | Weholt | 405/151 |
| 5,035,538 | A | * | 7/1991 | Mitchell | 405/151 |
| 5,066,167 | A | * | 11/1991 | Siegfried et al. | 405/150.1 |
| 5,118,220 | A | * | 6/1992 | Furumi et al. | 405/139 |
| 5,290,125 | A | * | 3/1994 | Trevisani | 405/150.1 X |
| 5,439,319 | A | * | 8/1995 | Flanagan et al. | 405/152 |
| 5,470,178 | A | * | 11/1995 | Weholt | 405/152 |
| 6,168,846 | B1 | * | 1/2001 | Molyneux | 405/150.1 |

FOREIGN PATENT DOCUMENTS

| | | | | |
|---|---|---|---|---|
| JP | 266299 | * | 8/1988 | 405/150.1 |
| JP | 6137087 | * | 4/1992 | 405/150.1 |

* cited by examiner

*Primary Examiner*—David Bagnell
*Assistant Examiner*—Sunil Singh

(57) ABSTRACT

The lining (1) of a tunnel is reinforced without reducing the tunnel bore. Grooves (6, 9) are cut into the tunnel lining (1) following the maximum curvature or skew to that, sometimes with one set of grooves crossing another set of different depth. Each groove (6, 9) is of generally T section and one or more rods (11) encased in a fabric sleeve (12) are inserted through the narrow mouth (6) of each groove (the stem of the T) to be within the enlarged part (9) ( the cross-bar of the T). Grout (13) injected into the sleeve expands it against the groove, and some seeps through to bond to the lining (1). Further anchoring may be achieved by drilling through the lining at the ends of the grooves into surrounding rock (15) to receive expansion bolts which are secured to the ends of the rods (11) or further grouted reinforced sleeves (17) which may be extensions of the main sleeves.

14 Claims, 4 Drawing Sheets

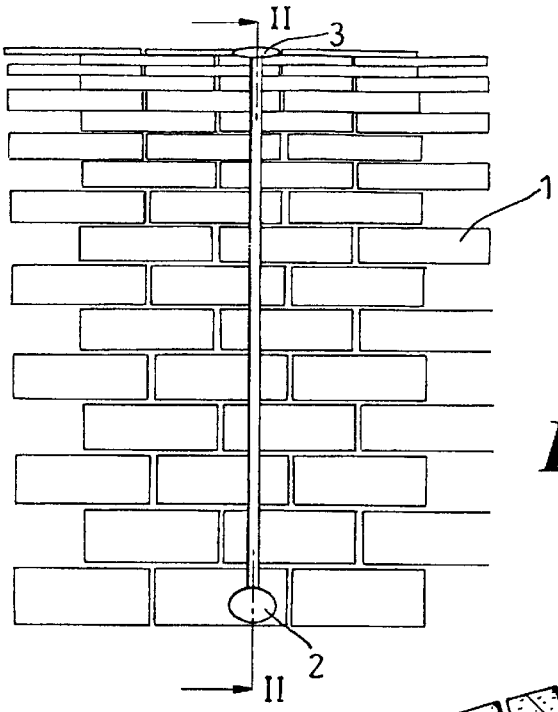
Fig. 1
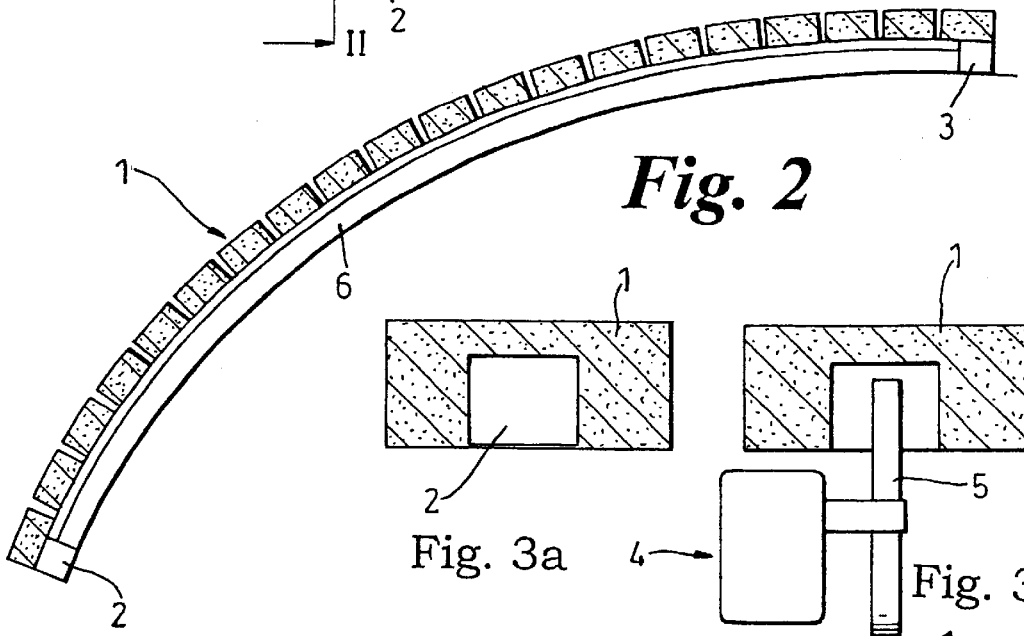
Fig. 2
Fig. 3a
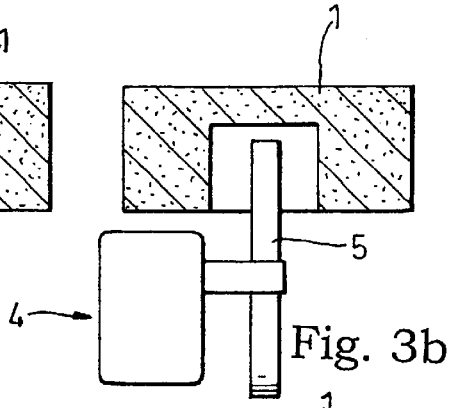
Fig. 3b
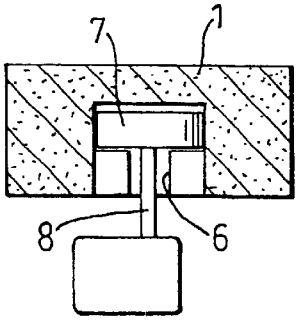
Fig. 3c
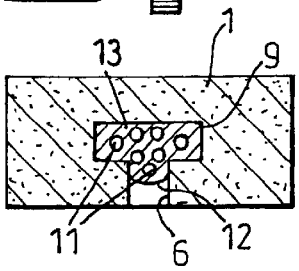
Fig. 3d

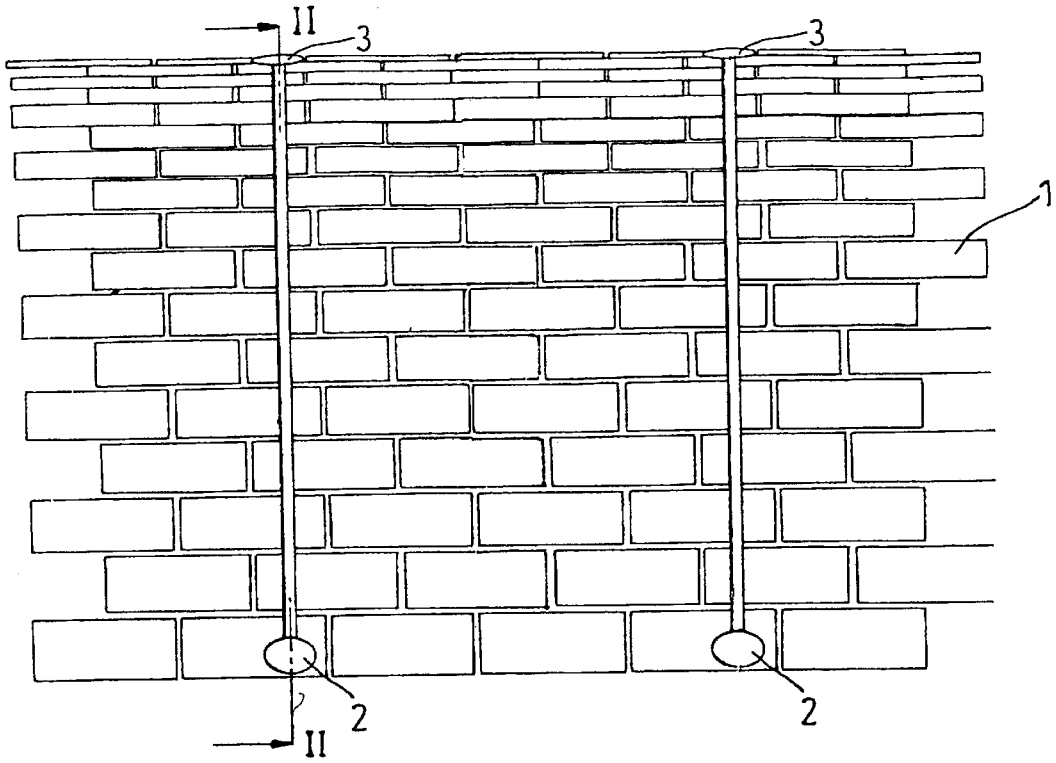
*Fig. 1*a
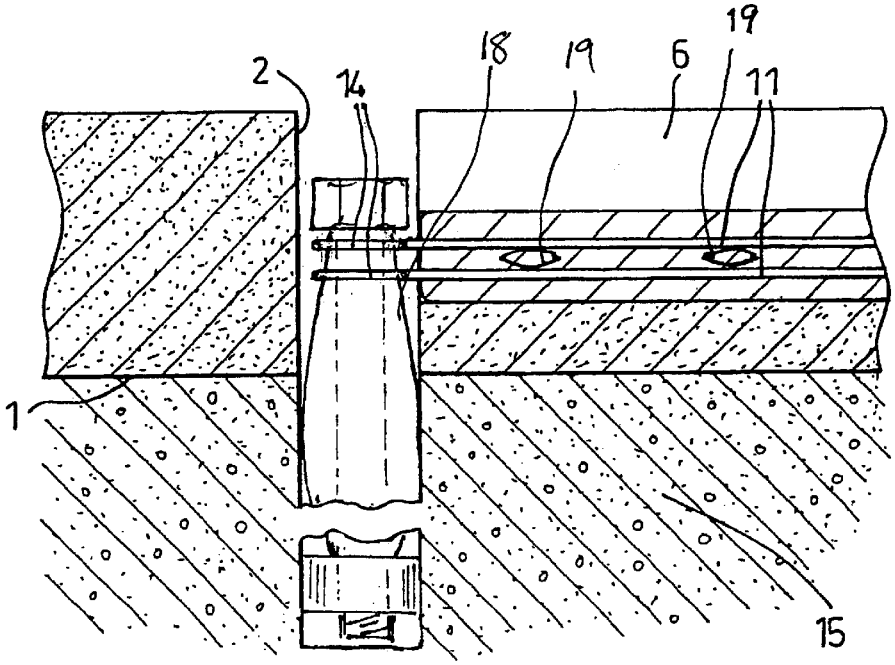
*Fig. 5*a

METHOD FOR REINFORCING TUNNEL LININGS

BACKGROUND OF THE INVENTION

This invention relates to tunnel reinforcements.

The word tunnel is used in this specification to encompass any apertured structures, such as an arched bridge, of any length. But other remedies can often be applied to short structures such as bridges where there is access to the outside of the arch.

Tunnels are often lined, and old ones are usually brick-lined. While many have survived remarkably well for over a hundred years or more, they do inevitably deteriorate and require attention. Sometimes, just re-pointing and the replacement of some bricks is sufficient, but when there has been movement and the original lining is distorted, or is reckoned to be at risk of collapse, more drastic treatment is required.

One method is to re-line the tunnel, covering the old brickwork with concrete. This is expensive, uses a great deal of material, and inevitably reduced the tunnel bore. Also, it does not lend itself to very local reinforcement, which may be all that is required.

A problem with tunnel linings is that they are only accessible from inside, and their curvature has usually meant that reinforcing bolts into the surrounding strata have extended substantially normally to the lining. Of course, those are virtually useless in sand, earth or rubble; they need to go into rock.

SUMMARY OF THE INVENTION

It is the aim of this invention to enable tunnel linings to be reinforced within themselves, enabling ever local strengthening and being independent of the nature of the ground through which the tunnel extends.

According to the present invention there is provided a method of reinforcing tunnel linings comprising the steps of:

(i) cutting a groove into the lining from inside, the mouth of the groove being narrower than the remaining enlarged part of the groove, (ii) injecting an embryo elongate reinforcement comprising at least one rod within a fabric sleeve through the mouth of the groove into said enlarged part, and (iii) injecting grout to fill the sleeve and expand it against the surface of the enlarged part, the grout seeping through and bonding to the lining, thereby completing the reinforcement.

Conveniently the groove will be formed in stages:

(i) a substantially parallel sided groove being cut into the lining from inside, (ii) a heading wider than the preliminary groove being made into that groove, (iii) a rotary cutter head with a diameter wider than the preliminary groove being entered into the heading so that the cutter head is beyond the inner surface of the lining and so that a shaft carrying the head registers with the preliminary groove, and (iv) the cutter head being rotated and traversed at substantially constant depth within the lining with the shaft being guided along the preliminary groove thereby to enlarge the preliminary groove internally of the lining.

Stages (i) and (ii) may be reversed.

One heading will generally be made at one end of the groove and a similar heading made at the other end, through which the cutter head may be withdrawn after the enlargement has been made.

The headings can be drilled deep, through the lining into surrounding rock, whereby each can received an elongate anchoring member that locks into the rock. The ends of the reinforcement are then advantageously captive to the elongate anchoring members within the headings.

These elongate anchoring members may be expansion bolts, or fabric sleeves containing one or more reinforcing rods, each sleeve being expanded and filled by grout injection. In another version, the embryo reinforcement may be longer than the groove and have its ends angled to extend out beyond the lining into the deep headings and to serve as the elongate anchoring members. A single grout injection then suffices to complete and make unitary the reinforcement and the anchoring members.

The reinforcement, when filled with grout, will often bulge into the mouth of the groove but not fill it. The filling can be completed by further grouting or pointing.

The reinforcement may have a plurality of generally parallel rods interconnected at intervals by spring elements that urge them apart. The rods can be bunched up to get thorough the narrow mouth of the groove, but then they will spread out again in the enlarged part.

The method will generally be repeated to form a set of reinforced grooves along a tunnel. These may follow the maximum curvature of the lining, or be skew thereto. Two sets of reinforced grooves may be provided, the enlarged parts of one set being deeper into the lining than the enlarged parts of the other set, and at least some of the grooves of one set being angled to cross at least some grooves of the other set. A reinforcing grid is thus formed.

BRIEF DESCRIPTION OF THE DRAWINGS

For a better understanding of the invention, one embodiment will now be described, by way of example, with reference to the accompanying drawings, in which:

FIG. 1 is an elevation, from inside, of part of the brick lining of an arched tunnel, FIG. 1*a* is similar to FIG. 1, except that two grooves are shown, FIG. 2 is a section on the line II—II of FIG. 1, FIG. 3 is a sequence diagram showing part of the lining in cross-section being reinforced, FIG. 5*a* is a cross-sectional detail of a modified reinforcement.

DETAILED DESCRIPTION OF THE PREFERRED EMBODIMENTS

Figure 4A:
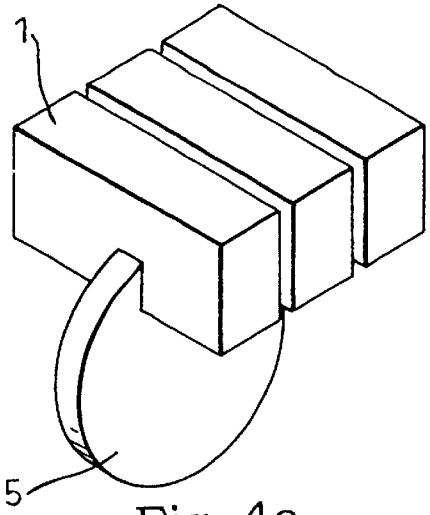
FIG. 4 is another such diagram, in broken away perspective view.
Figure 4B:
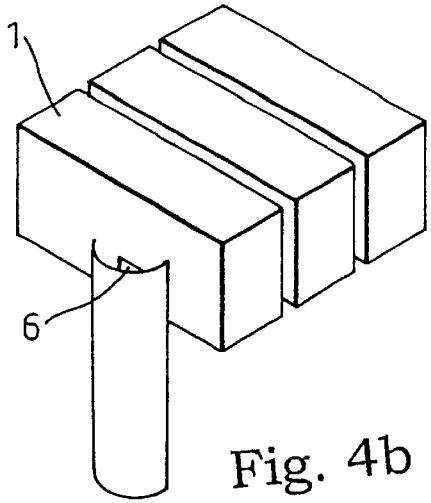
Figure 4C:
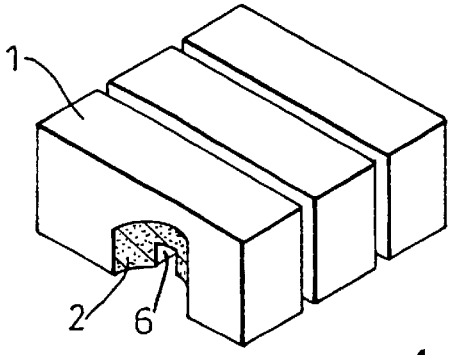
Figure 4D:
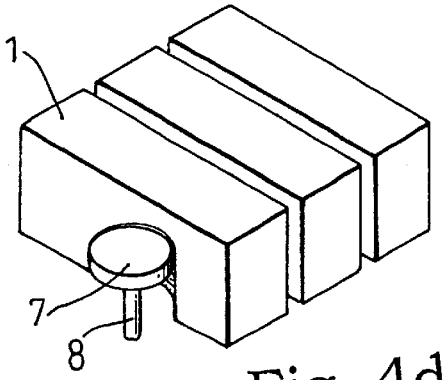
Figure 4E:
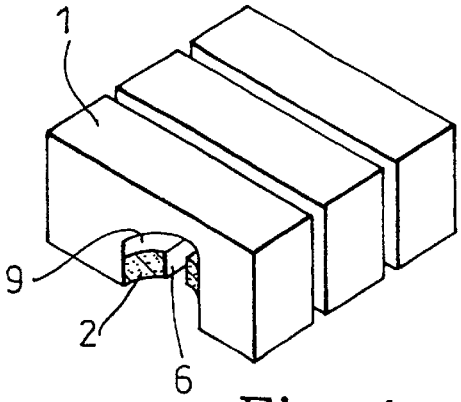
Figure 4F:
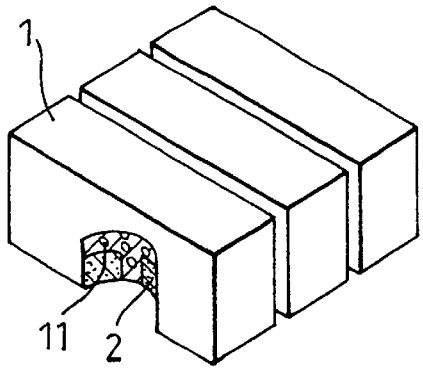

An arched tunnel lining 1 is of brick laid in courses longitudinally of the tunnel. The lining may be two or more courses thick, but just one is shown here for simplicity. Often, when reinforcement is needed, the lining is strengthened by supplementary rings or hoops following the cross-sectional curvature, but the technique to be described knits the courses together with hoops set into the brickwork rather than merely supporting the courses from inside the tunnel.

For each hoop two drillings 2 and 3 are made normally into the tunnel lining with large diameter bits. In FIGS. 1 and 2 they are made at the base and the crown of the arch, but their spacing can be longer or shorter. The drillings shown in these figures do not penetrate through the brickwork, but they could do so as described below.

A disc cutter 4 is then applied to the lining and a large flat disc 5 cuts a groove 6, or alternatively more than one groove may be cut (as seen in FIG. 1*a*) between the drillings 2 and 3, following the cross-sectional curvature and cutting at an even depth. It is probably advantageous to cut this preliminary groove as deep as the finished groove will be so that the next cut, described below, is only a lateral enlargement of part of the groove 6. The depth can be governed by a follower on the cutter body that travels over the inside of the lining 1. The centre of the groove 6 aligns with the axes of the drillings 2 and 3.

The disc 5 is then replaced by a smaller, thicker disc 7, which can enter either drilling 2 or 3. But its thickness is substantially less than the depth of the groove 6 and its distal face is set at a depth within one of those drillings substantially equal to the depth of the groove. The cutter is then energised and traversed to the other drilling, the cutter spindle or shaft 8 following the mouth of the groove 6 and the disc 7 forming an enlargement 9 in the groove 6, which makes its cross-section T-shaped. At the end of the traverse, the cutter is withdrawn, removing the disc 7 via the other drilling.

FIG. 4 also shows this process, and indicates that the groove 6 may be cut before the drillings 2 and 3 are made by drill bit 10.

It will be understood that the disc 7 is not the only possible shape with which to make the second cut. For example, the cutter head could be spherical or elliptical, to make a smoothly rounded enlargement 9.

Instead of making two passes to complete each groove with different tools, it would be possible to perform the operation in one pass by having a rotary tool with a stepped cylindrical cutting head, the larger diameter portion forming the enlargement 9 and the smaller diameter portion the mouth of the groove. However, that would probably require a custom-made tool, while the separate disc and drum cutters are readily available.

It may also be possible in some circumstances not to use headings: the groove cutter or cutters would be angled to "eat their way" into the lining and then be straightened up to traverse the lining as described. However, that is not preferred since, as described below, the headings may be extended to serve a further purpose.

A reinforcement is inserted into the groove 6 once that is formed. Initially it is a bundle of rods 11 within a fabric sleeve 12, and this can be manipulated into a sufficiently flat package to be worked through the mouth of the groove 6 (the stem of the T) into the enlargement 9. The rods will of course be sufficiently bendable, if not pre-formed to the required curvature, to follow the curved groove. Once in the enlargement 9, they are spread out as much as can be achieved by manipulation through the mouth of the groove and the fabric sleeve, but it may be possible to have sprung spacers 19 (as shown in FIG. 5*a*) at intervals along their length which will allow compression for entry and cause expansion after entry.

When in place, grout 13 is injected into the fabric sleeve 12. This expands it against the wall of the enlargement 9 and causes it to bulge into the mouth of the groove 6. Some grout will seep thorough the fabric and bond to the brick. When the grout has set, the reinforcement is complete, although preferably the mouths of the drillings 2 and 3 and of the groove 6 will be filled with cement and pointed.

Figure 5:
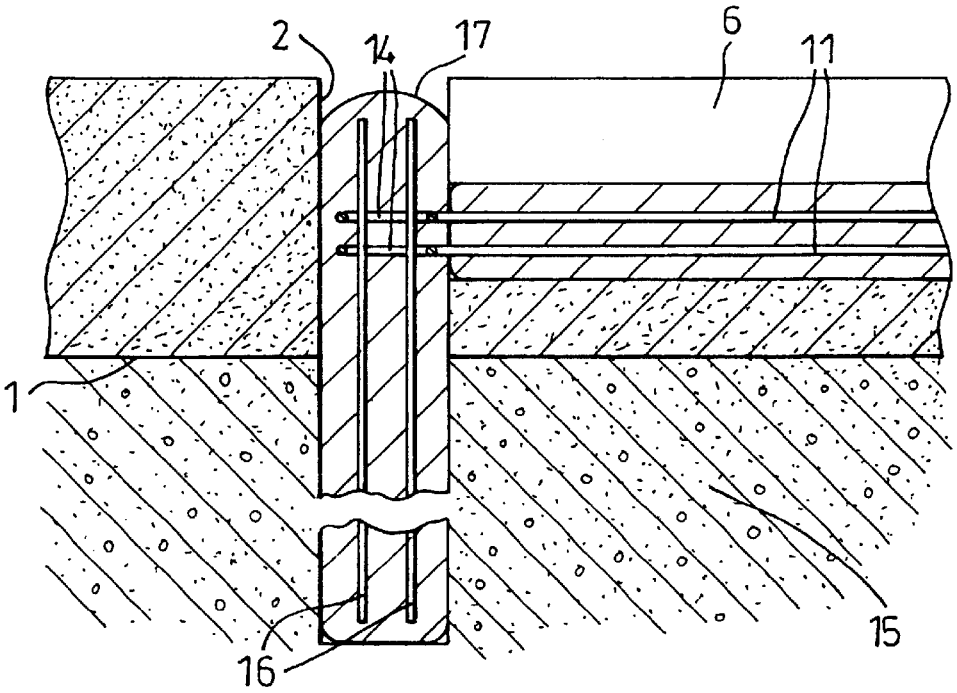
FIG. 5 is a cross-sectional detail of an additional reinforcement.

The ends of the rods 11 may emerge from the sleeve 12 within the drillings 2 and 3, and be formed into or joined to rings 14 as shown in FIG. 5. The drillings may be made right through the lining 1 into surrounding rock 15. Reinforcements can then be entered through the rings 14 with their distal ends well beyond the lining and their proximal ends within the mouths of the drillings. They could be normal expansion bolts 18 (as shown in FIG. 5*a*), but generally it will be preferred to use a bundle of rods 16 within a fabric sleeve 17, similar to but shorter than the reinforcement described above.

Grout can be injected simultaneously with the injection into the sleeve 12 so that everything will solidify together.

Figure 6:
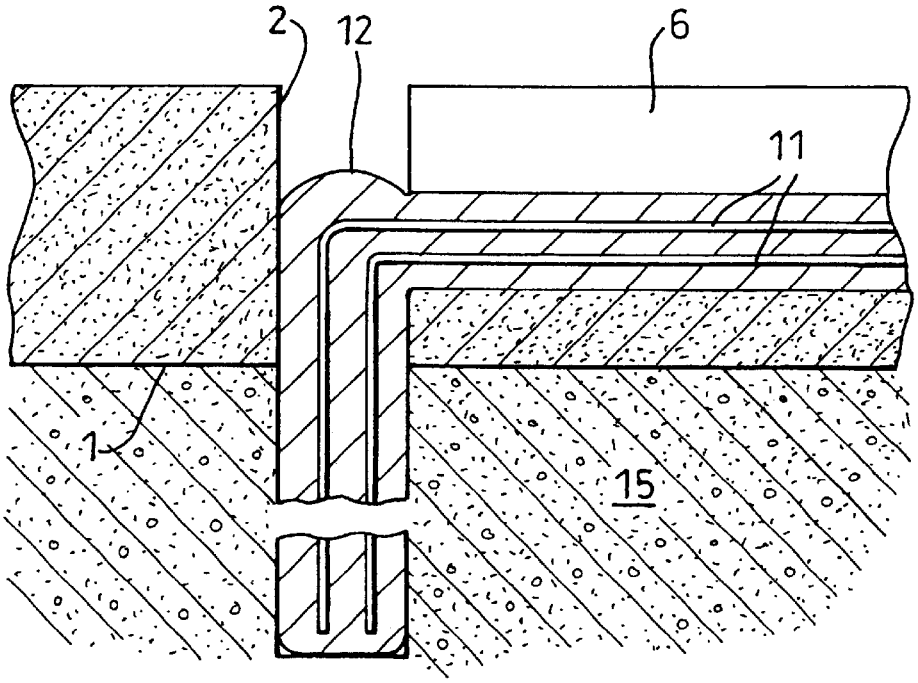
FIG. 6 is a cross-sectional detail of a modified reinforcement.

Instead of separate reinforcements, as shown in FIG. 6 the drillings 2 and 3 could receive the bent over ends of the rods 11 within the sleeve 12, these being made longer than in the arrangement first described.

The reinforcements were referred to above as following the cross-sectional curvature, which will be the maximum curvature. However, they may be set skew, which of course would mean less curvature and therefore less bending of the reinforcing rods. Furthermore, if one set of grooves is made deeper than another set, the sets being mutually skew, there can then be a network or grid of reinforcements crossing each other, making an extra strong lining.

What is claimed is:

1. A method of reinforcing tunnel linings comprising the steps of:

(i) cutting a groove into the lining from inside, the mouth of the groove being narrower than the remaining enlarged part of the groove, (ii) injecting an embryo elongate reinforcement comprising at least one rod within a fabric sleeve through the mouth of the groove into said enlarged part, and (iii) injecting grout to fill the sleeve and expand the sleeve against the surface of the enlarged part, the grout seeping through the sleeve and bonding to the lining, thereby completing the reinforcement.

2. A method as claimed in claim 1, wherein the groove is formed in stages by the steps of:

(i) cutting a substantially parallel sided preliminary groove into the lining from inside, (ii) making a heading wider than the preliminary groove into the preliminary groove, (iii) entering a rotary cutter head with a diameter wider than the preliminary groove into the heading so that the rotary cutter head is beyond the inner surface of the lining and so that a shaft carrying the rotary cutter head registers with the preliminary groove, and (iv) rotating and traversing the cutter head as substantially constant depth within the lining with the shaft being guided along the preliminary groove thereby to enlarge the preliminary groove internally of the lining.

3. A method as claimed in claim 2, wherein the heading is made at one end of the groove and a similar heading is made at the other end, through which the cutter head may be withdrawn after the enlargement has been made.

4. A method as claimed in claim 3, wherein the headings are drilled deep, through the lining into surrounding rock, whereby each can receive an elongated anchoring member that locks into the rock, and wherein the ends of the reinforcement are captive to the elongate anchoring members within the headings.

5. A method as claimed in claim 4, wherein the elongate anchoring members are expansion bolts.

6. A method as claimed in claim 4, wherein the elongate anchoring members are fabric sleeves containing one or more reinforcing rods, each sleeve being expanded and filled by grout injection.

7. A method as claimed in claim 4, wherein the embryo reinforcement is longer than the groove and its ends are angled to extend out beyond the lining into the deep headings and to serve as the elongate anchoring members, whereby a single grout injection suffices to complete and make unitary the reinforcement and the anchoring members.

8. A method as claimed in claim 1, wherein the groove is formed in stages by the steps of:

i) making a heading into the lining ii) cutting substantially parallel sided preliminary groove narrower than the heading into the lining from inside and opening into the heading, iii) entering a rotary cutter head with a diameter wider than the preliminary groove into the heading so that the cutter head is beyond the inner surface of the lining and so that a shaft carrying the cutter head registers with the preliminary groove, and iv) rotating and traversing the cutter head at substantially constant depth within the lining with the shaft being guided along the preliminary groove thereby to enlarge the preliminary groove internally of the lining.

9. A method as claimed in claim 1, wherein the reinforcement, when filled with grout, bulges into the mouth of the groove but does not fill it, and wherein the filling is completed by further grouting or pointing.

10. A method as claimed in claim 1, wherein the reinforcement has a plurality of generally parallel rods interconnected at intervals by spring elements that urge them apart.

11. A method as claimed in claim 1, wherein the method of claim 1 is repeated to form a set of reinforced grooves.

12. A method as claimed in claim 11, wherein the grooves follow the maximum curvature of the lining.

13. A method as claimed in claim 11, wherein the grooves are skew to the maximum curvature of the lining.

14. A method as claimed in claim 11, wherein there are two sets of reinforced grooves, the enlarged parts of one set being deeper into the lining than the enlarged parts of the other set, and at least some of the grooves of one set being angled to cross at least some grooves of the other set.

* * * * *